US009515401B1

(12) United States Patent
Bartley et al.

(10) Patent No.: US 9,515,401 B1
(45) Date of Patent: Dec. 6, 2016

(54) ELASTOMERIC ELECTRICAL CONNECTOR STRUCTURE JOINING TWO HARDWARE PLANES AT RIGHT ANGLES TO EACH OTHER

(71) Applicant: International Business Machines Corporation, Armonk, NY (US)

(72) Inventors: Gerald K. Bartley, Rochester, MN (US); Darryl J. Becker, Rochester, MN (US); Matthew S. Doyle, Chatfield, MN (US); Mark J. Jeanson, Rochester, MN (US); Mark O. Maxson, Mantorville, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 14/987,641

(22) Filed: Jan. 4, 2016

(51) Int. Cl.

| | |
|---|---|
| ***H01R 12/00*** | (2006.01) |
| ***H01R 12/70*** | (2011.01) |
| ***H01R 43/20*** | (2006.01) |
| ***H01R 12/77*** | (2011.01) |
| ***H01R 13/24*** | (2006.01) |

(52) U.S. Cl.
CPC ..... *H01R 12/7076* (2013.01); *H01R 12/77* (2013.01); *H01R 13/2414* (2013.01); *H01R 43/205* (2013.01)

(58) Field of Classification Search
CPC ..... H01R 9/096; H01R 12/62; H01R 12/79; H01R 13/2414; H01R 13/2435
USPC ..... 439/66, 67, 91
See application file for complete search history.

(56) References Cited

U.S. PATENT DOCUMENTS

| | | | | |
|---|---|---|---|---|
| 5,123,852 A * | 6/1992 | Gillett | H01R 12/853 | 439/496 |
| 5,197,888 A * | 3/1993 | Brodsky | H05K 3/365 | 439/378 |
| 6,241,533 B1 * | 6/2001 | Matsumoto | H01R 13/2414 | 439/66 |
| 6,386,890 B1 * | 5/2002 | Bhatt | H01R 12/7047 | 439/66 |
| 7,331,796 B2 * | 2/2008 | Hougham | H05K 3/326 | 439/66 |
| 7,381,060 B2 * | 6/2008 | Ju | H01R 13/2435 | 439/66 |
| 8,109,768 B2 * | 2/2012 | Nikaido | H01R 12/57 | 174/262 |
| 8,708,711 B2 * | 4/2014 | Horikawa | H01R 12/52 | 439/66 |

(Continued)

OTHER PUBLICATIONS

IBM et al.; "Security Enclosure with Elastomeric Contact Stripes"; An IP.com Prior Art Database Technical Disclosure; http:ip.com/IPCOM/000119716; Apr. 2, 2005.

(Continued)

*Primary Examiner* — Chandrika Prasad
(74) *Attorney, Agent, or Firm* — Kevin Kehe

(57) ABSTRACT

Disclosed aspects relate to an elastomeric electrical connector structure. A first physical hardware plane has a first group of electrical contacts to establish a first portion of a set of electrical connections. A second physical hardware plane has a second group of electrical contacts to establish a second portion of the set of electrical connections. The elastomeric electrical connector structure is to join the first and second portions of the set of electrical connections. The elastomeric electrical connector structure includes a first state having a first distance between the first and second physical hardware planes, and a second state having a second distance between the first and second physical hardware planes. The first distance exceeds the second distance.

16 Claims, 11 Drawing Sheets

(56) References Cited

U.S. PATENT DOCUMENTS

| | | | | |
|---|---|---|---|---|
| 8,870,580 | B2 * | 10/2014 | Kojima | H01R 13/40 439/66 |
| 9,049,010 | B2 | 6/2015 | Jueneman et al. | |
| 2005/0282409 | A1 * | 12/2005 | Brodsky | H01R 13/2407 439/66 |
| 2011/0151688 | A1 * | 6/2011 | Beaman | H01R 12/585 439/66 |
| 2014/0006778 | A1 | 1/2014 | Dixon et al. | |
| 2014/0245785 | A1 | 9/2014 | Proud et al. | |
| 2014/0245789 | A1 | 9/2014 | Proud et al. | |
| 2014/0246500 | A1 | 9/2014 | Proud et al. | |

OTHER PUBLICATIONS

Internet Society RFCs et al.; "Extension to Sockets APi for Mobile IPv6"; An IP.com Prior Art Database Technical Disclosure; http://ip.com/IPCOM/000138290; Jul. 15, 2006.

Tyco Electronics, Elastomeric Connectors, <http://www.te.com/commerce/DocumentDelivery/DDEController?Action=srchrtrv&DocNm=3-1773443-0&DocType=DS&DocLang=>.

Fujipoly, Zebra Elastomeric Connectors, <http://www.fujipoly.com/usa/products/zebra-elastomeric-connectors/>.

PCMag, Definition of: elastomeric connector, <http://www.pcmag.com/encyclopediatterm/67107/elastomeric-connector>.

List of IBM Patents or Patent Applications Treated As Related.

* cited by examiner

200

400

600

700

ELASTOMERIC ELECTRICAL CONNECTOR STRUCTURE JOINING TWO HARDWARE PLANES AT RIGHT ANGLES TO EACH OTHER

BACKGROUND

This disclosure relates generally to electrical connections for electronics and, more particularly, relates to a connector system. The density of interconnects can be related to a number of physical and electrical factors. Contacts spacing can include both mechanical factors such as alignment and electrical factors such as impedance discontinuities and coupling as the interconnects become closer together. Designers make trade-offs between signal counts (both high-speed and control signals), and power/shielding requirements. Customization within a mechanical form-factor may provide benefits.

SUMMARY

Aspects of the disclosure relate to an elastomeric electrical connector structure. A first physical hardware plane has a first group of electrical contacts to establish a first portion of a set of electrical connections. A second physical hardware plane has a second group of electrical contacts to establish a second portion of the set of electrical connections. The elastomeric electrical connector structure is to join the first and second portions of the set of electrical connections. The elastomeric electrical connector structure includes a first state having a first distance between the first and second physical hardware planes, and a second state having a second distance between the first and second physical hardware planes. The first distance exceeds the second distance.

Aspects of the disclosure relate to connector structures and a card. A first connector structure is to join a first subset of a set of electrical connections. A second connector structure is to join a second subset of the set of electrical connections. The card manages the set of electrical connections and is located between the first and second connector structures to connect with the first and second connector structures.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
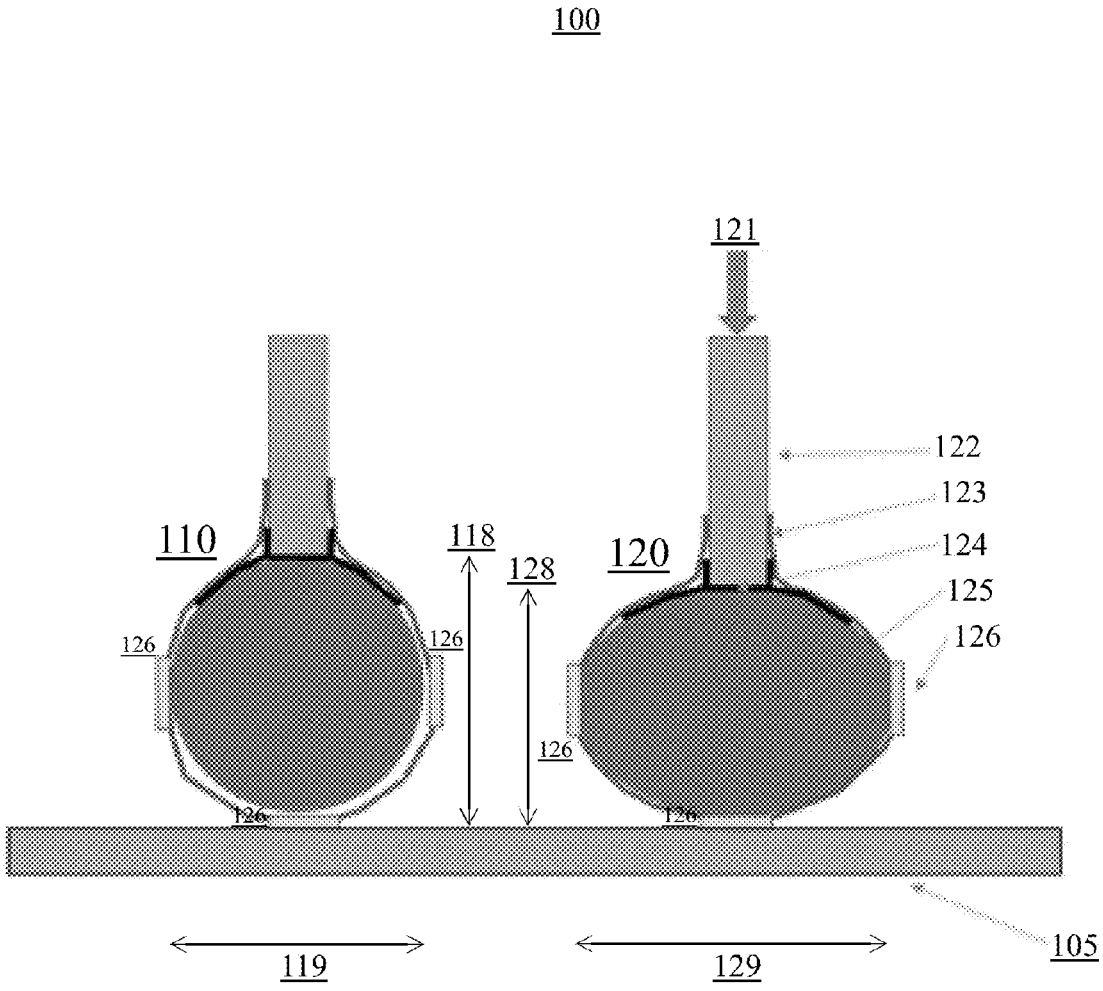
FIG. 1 depicts a side-view cutout of a set of elastomeric electrical connector structures and a set of physical hardware planes according to embodiments.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the disclosure relate to a morphing elastomeric connector structure. Aspects also relate to a system for enabling verification/authorization (e.g., debug, update, security) which can include using a sequence of keys inserted into a socket. Disclosed aspects include a midplane or backplane configuration where an elastomeric connector can be coupled with flexible circuitry to allow for positive impacts related to the wiring and power distribution capacity with respect to a typical backplane. Also, features can be used by probing or accessing signals to securely update data, for verification of function, to debug, to perform diagnostic actions, or to appropriately control information.

In embodiments, a connector is disclosed with various sizes of elastomeric cores (e.g., cylinders). Features may provide an alternate/separate interconnect path between a group of cards. A multilayer flex can produce various impedances appropriate for various interfaces within the same connector. In certain embodiments, connectors may not be identical with a given system (e.g., different sizes). In various embodiments, power decoupling/filtering components may be mounted on the connector structure. Aspects of the disclosure include multiple-sided interconnection supported with a rigid flex and an appropriate stiffener structure. As such, a higher copper density can have positive impacts with respect to (more) signaling or (better) power structure. Also, connector electrical characteristics may be specifically/efficiently matched with the requirements of a particular interface.

Aspects of the disclosure may have performance or efficiency benefits. Connections along a plurality of axis may be enabled by the connector (e.g., as the elastomeric core is squeezed the connector elongates and creates pressure on sides to allow for connections in another axis). The connector may be constructed from a physical elastomer or from a bladder-like cylinder filled with an oil or other liquid. Also, aspects may facilitate connecting a directly adjacent connector to the connector, or connecting through a traditional connection to a backplane, midplane, or flex-circuit structure. For example, wiring capacity may be increased which can allow for higher speed interconnects. A flexible circuit (e.g., flex portion of the connector attached to a traditional card) can be configured for single ended, differential signaling, highly shielded (isolated) signals, different impedances, power, ground, etc. Features described herein allow for connections without large pin-in hole/compliant pin, and associated/subsequent wiring blockages. Use of the connector allows for direct card-to-card connections, avoiding various parasitics associated with connecting through a backplane (e.g., providing more efficient or higher communications).

In embodiments, a card may be placed between adjacent compressed/uncompressed connectors. Accordingly, such placement of the card may allow for accessing signals or power for various verifications, testing, or monitoring. In certain embodiments, an inserted card may be used to enable/disable functions (e.g., for security). In various embodiments, the card may be utilized as a key-like function using one or more (or a sequence of) "keys" in the form of cards that are inserted between the compressible connectors. The key card may have storage to allow the loading of software, data such as secure data, etc. Aspects of the disclosure may have performance or efficiency benefits associated with intercepting, re-routing, truncating, probing, or shorting signals which are routed between adjacent connectors (e.g., key card, access card, probing, interjecting of signals). Moreover, aspects may decode or monitor contents/signaling which is otherwise encrypted.

FIG. 1 depicts a side-view cutout 100 of a set of elastomeric electrical connector structures and a set of physical hardware planes according to embodiments. A first physical hardware plane 105 (e.g., backplane, midplane) may have a first group of electrical contacts to establish a first portion of a set of electrical connections. A second physical hardware plane 122 (e.g., printed circuit board, card, side card) may have a second group of electrical contacts to establish a second portion of the set of electrical connections (e.g., and may use an alignment/capture channel 124). By providing (vertical) force 121 from the second physical hardware plane 122 to an elastomeric electrical connector structure (as at second state 120 having an elastomer 125 which may be naturally cylindrical at at first state 110), the contact pads on a flexible circuit 123 (of the elastomeric electrical connector structure) aligned with contact pads 126 (or another connection element) on the backplane may connect and the elastomer 125 can become more elliptical in shape. As the elastomer 125 elongates, a connection with an adjacent connector system or card may occur (e.g., to join the first and second portions of the set of electrical connections).

Accordingly, the elastomeric electrical connector structure includes a first state 110 and a second state 120. The first state 110 (e.g., uncompressed) has a first distance 118 (e.g., vertical measurement) between the first and second physical hardware planes. The second state 120 (e.g., compressed) has a second distance 128 between the first and second physical hardware planes 105/122, and the first distance 118 exceeds the second distance 128. The first and second distances can measure along a substantially perpendicular plane with respect to the first physical hardware plane 105 (and a substantially parallel plane with respect to the second physical hardware plane 122). The first and second distances may measure between a top-face of the first physical hardware plane 105 (e.g., top of the backplane) and a bottom-edge of the second physical hardware plane 122 (e.g., bottom of the side card). The first state 110 may have a third distance 119 that perpendicularly bisects the first distance 118 between the first and second physical hardware planes. The second state 120 may have a fourth distance 129 that perpendicularly bisects the second distance 128 between the first and second physical hardware planes. As such, the third and fourth distances may measure across the elastomeric electrical connector structure in their respect states 110/120. Accordingly, the fourth distance 129 exceeds the third distance 119.

The elastomer-supported connector structure allows for a flexible circuit interconnect which can be configured for power, ground, or shielding while incorporating differential signals (e.g., even at different impedances within the same connector). The configuration may occur using specific design features within the flexible circuit. The shape of the connector structure may facilitate use of one or more alternate paths to reach adjacent cards (e.g., not required to go through the backplane or midplane). Structurally, the second physical hardware plane may be substantially perpendicular (e.g., within a threshold angle, between 85 and 95 degrees) with respect to the first physical hardware plane.

A set of contact pads 126 may be attached to the flexible circuit for connections at the base to the backplane as well as to the left and right. For example, a first contact pad of the set of contact pads may touch/contact/link-with, in the second state, a second contact pad which is not attached to the flexible circuit (e.g., of a backplane, midplane, multiple-sided flexible circuit structure). In various embodiments, the second contact pad is attached to a second flexible circuit (e.g., of a second elastomeric electrical connector structure, of a multiple-sided flexible circuit structure). The left and right connections can make contact as pressure in-line with the card (e.g., from above as depicted) compresses the elastomer. Compression of the elastomer may result in the structure elongating in the horizontal axis. In certain embodiments, contact with an adjacent card may result. Thus, signaling without passing through the backplane may be enabled (e.g., an alternate and parallel path). For example, a third physical hardware plane (e.g., a card or key card) having a third group of electrical contacts to establish a third portion of the set of electrical connections may be included (see also, e.g., FIG. 2/6/7). Accordingly, a direct electrical connection of the set of electrical connections includes the second and third portions but not the first portion (e.g., not including the backplane portion).

Altogether, aspects described may enable an alternate/separate interconnect path between adjacent cards, or groups of cards. In certain embodiments, a multilayer flexible circuit can produce various impedances appropriate for various interfaces within the same connector. In various embodiments, not all connectors need to have the same electrical characteristics within a system, yet the mechanical characteristics can be the same. Aspects may provide for alternate/additional interconnect paths (e.g., topside connections, card-card cables) which may reduce the wiring stress on the backplane or midplane. As a differentiation with respect to cables and topside connectors, aspects described herein may be integrated into the connector (e.g., without requiring additional hardware to enable operation). In embodiments, the flexible circuit can provide a configurable location for decoupling, filters, or other embedded or discrete components.

Figure 2:
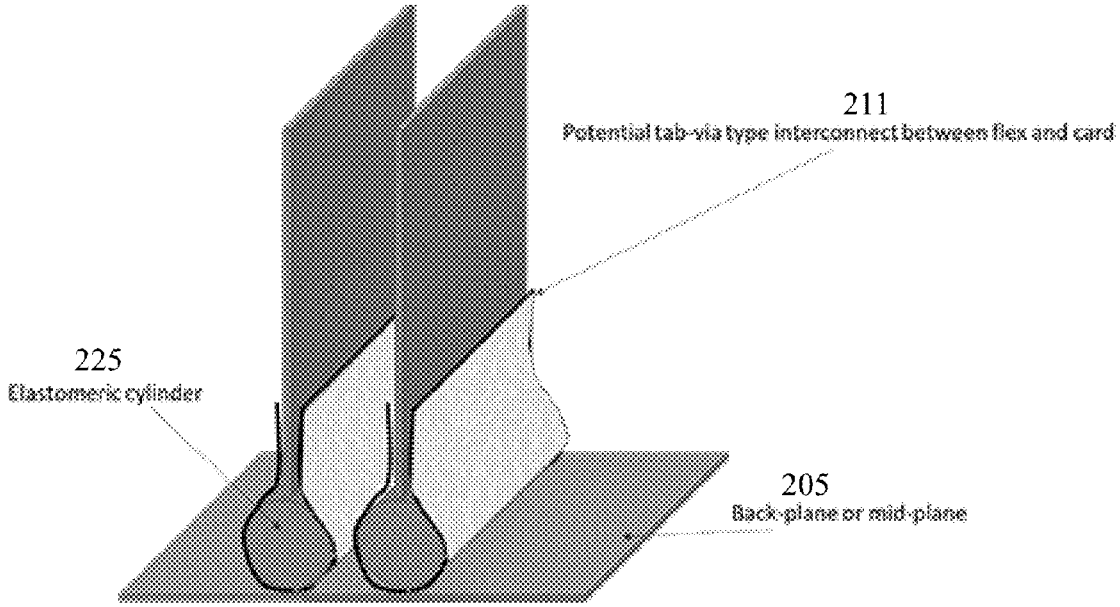
FIG. 2 depicts a perspective view of a set of elastomeric electrical connector structures and a set of physical hardware planes according to embodiments.

FIG. 2 depicts a perspective view 200 of a set of elastomeric electrical connector structures and a set of physical hardware planes (e.g., 205) according to embodiments. The connector structure includes an elastomeric core/cylinder 225 essentially wrapped/packaged by a flexible circuit 211 and positioned at the edge of the card. The flexible circuit 211 can be attached along the card axis. For instance, the flexible circuit 211 can be attached on both faces of the second physical hardware plane.

Due at least in part to the connection card to backplane (or card-to-card) being comprised of a flexible circuit type structure, the transmission line characteristics can be tailored for the impedance and resistance better-suited for the particular signaling standard. Many connector systems are of a fixed geometry (e.g., at least within a physical modular block). Such systems may be typically for power, differential signals, or general purpose signaling. As described herein, each signal could be configured/optimized for its intended purpose. For instance, if a single ended signal would best be 35, 50, or 60 ohms, then the line width of the individual signals may be varied. As another example, varying the physical dimensions of the flexible circuit may provide the desired configuration if the system relates to a differential signal. For instance, the flexible circuit of the elastomeric electrical connector structure may a first physical dimension, a second elastomeric electrical connector structure may include a second elastomeric core wrapped by a second flexible circuit having a second physical dimension, and the first and second physical dimensions can be different. In embodiments, different cards within the same system can have specially-configured electrical characteristics without changing the overall system structure. Not all connectors within the system are required to be identical, and essentially can be configured on a signal-by-signal basis.

Figure 3:
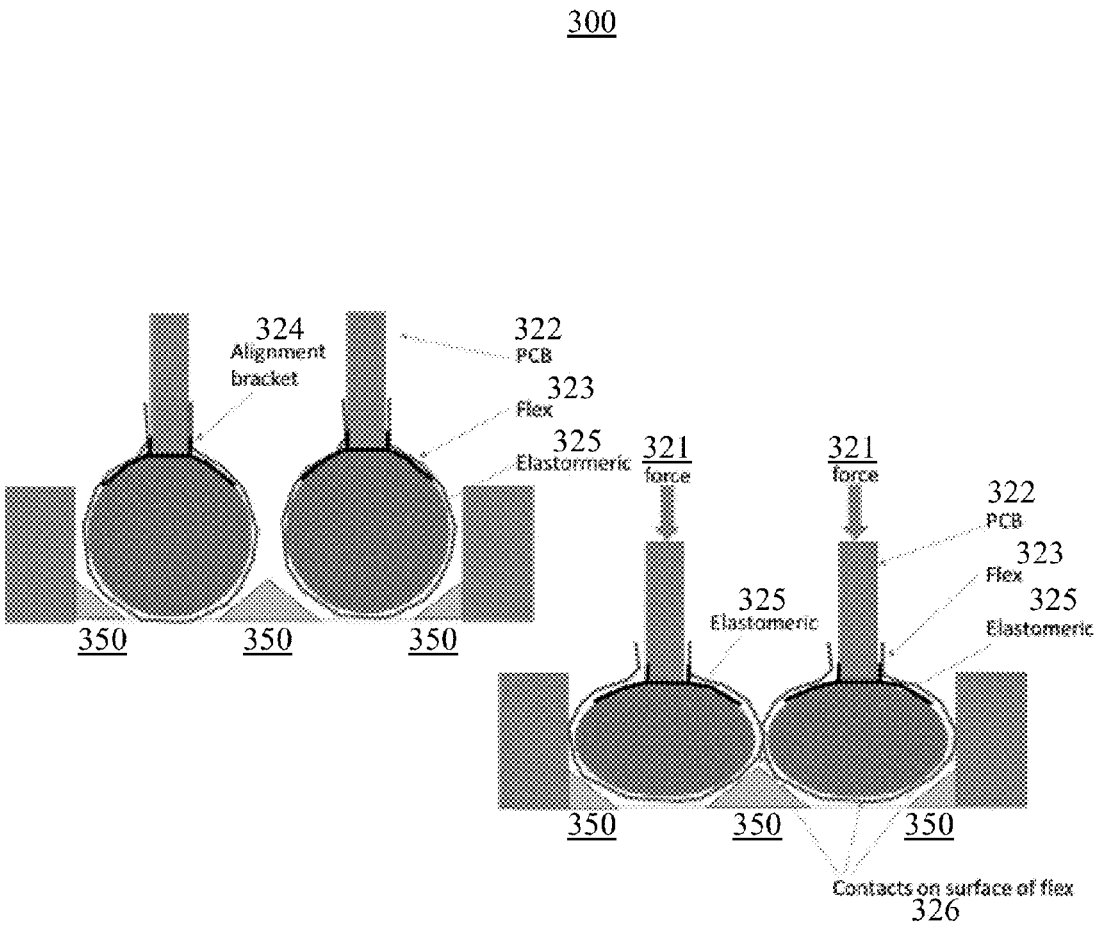
FIG. 3 depicts a side-view of a set of elastomeric electrical connector structures and a set of curbs attached to the first physical hardware plane to align and shape the set of elastomeric electrical connector structures according to embodiments.

FIG. 3 depicts a side-view 300 of a set of elastomeric electrical connector structures and a set of curbs 350 attached to the first physical hardware plane to align and shape the set of elastomeric electrical connector structures according to embodiments. Alignment features such as a set of curbs 350 may be attached to the first physical hardware plane (e.g., backplane). Various alignment features (e.g., set of curbs) may aid in positioning and assembling the cards within the system including course alignment and in shaping the connector structure (e.g., from a side-view-circle to a side-view-ellipse). The set of curbs 350 can align and shape the elastomeric electrical connector structure. Other more alignment approaches such as supported slots (e.g., perhaps within a card cage, or alignment pins which could provide centerline alignment) are also possible and contemplated. Also depicted and used as described herein (see e.g., description related to FIG. 1) are contacts 326, elastomerics 325, flexible circuits 323, forces 321, printed circuit boards 322, and an alignment bracket 324.

Figure 4:
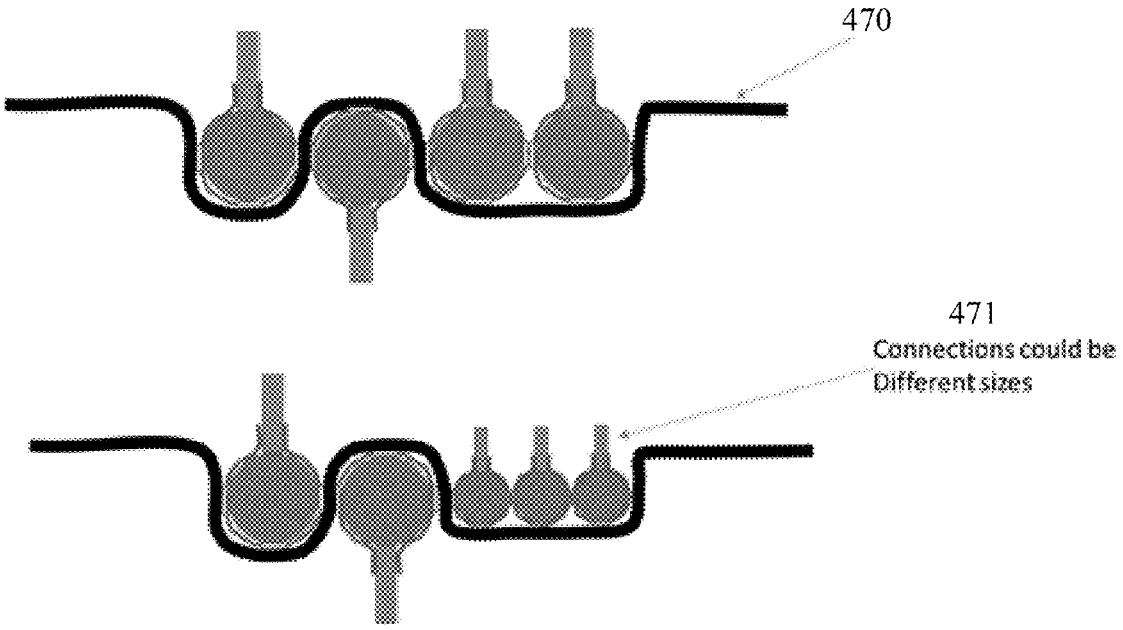
FIG. 4 depicts a side-view of a set of elastomeric electrical connector structures and a multiple-side flexible circuit structure according to embodiments.

FIG. 4 depicts a side-view 400 of a set of elastomeric electrical connector structures and a multiple-side flexible circuit structure according to embodiments. Flexible circuit technology may be incorporated such as an (extremely) rigid flexible circuit 470 (e.g., a multiple-sided flexible circuit structure). As such, a double-sided structure may accomplish the task of the typical backplane (or midplane) printed circuit board technology. A second elastomeric electrical connector structure may be a different size relative to the elastomeric electrical connector structure (e.g., as shown by connectors 471).

Figure 5:
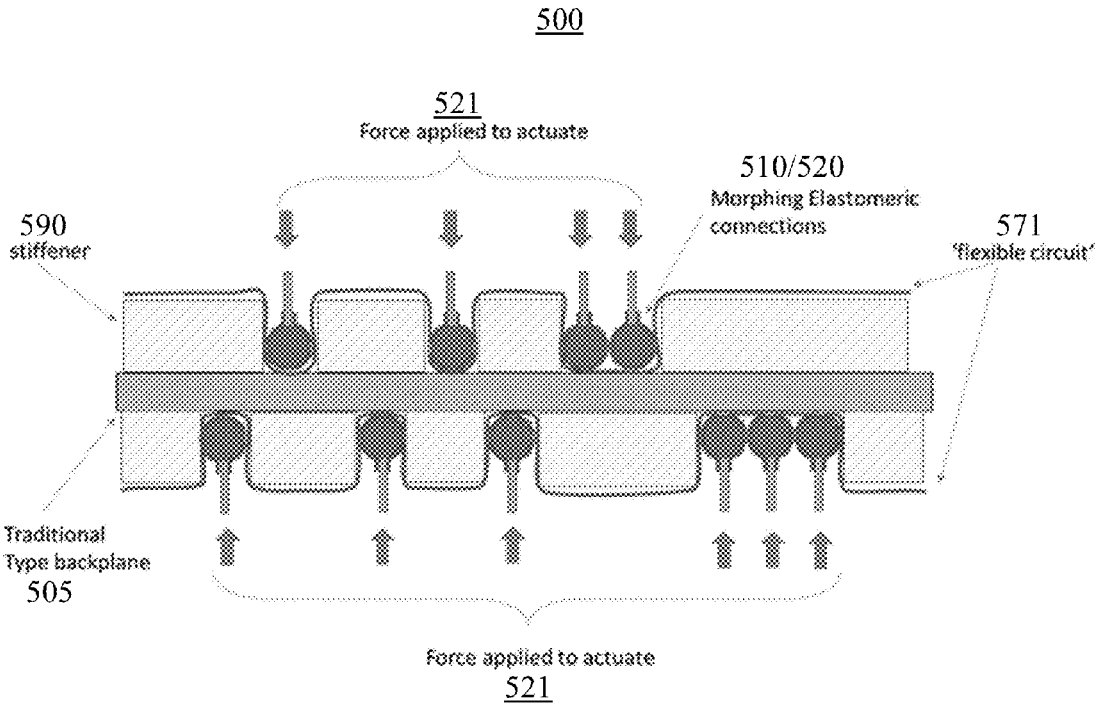
FIG. 5 depicts a side-view of a set of elastomeric electrical connector structures in a system structure according to embodiments.
Figure 5:
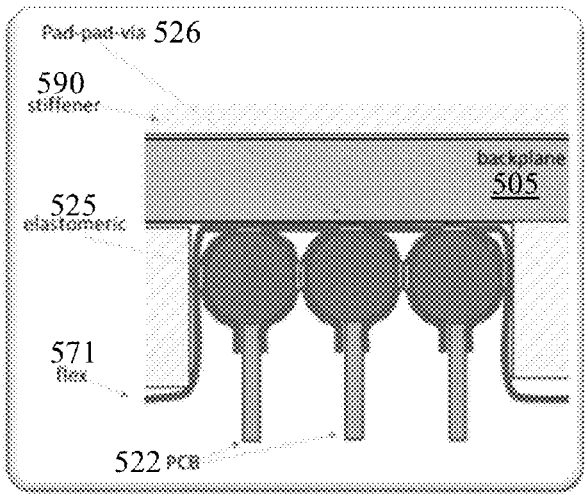

FIG. 5 depicts a side-view 500 of a set of elastomeric electrical connector structures in a system structure according to embodiments. A stiffener structure 590 which is affixed to the first physical hardware plane 505 and coupled with a multiple-sided flexible circuit structure 571 may be utilized. Using the multiple-sided flexible circuit structure 571 within the elastomeric connector system may have performance or efficiency benefits in flexibility and connectivity with respect to the typical backplane or midplane system structure. In embodiments, the first physical hardware plane 505 (e.g., backplane) can be coupled with a multiple-sided flexible circuit structure 571. In embodiments, a set of contact pads 526 (at least a portion of which may be attached to the flexible circuit of the elastomeric electrical connector structure) can touch the multiple-sided flexible circuit structure 571. An increase in flexibility/connectivity can be utilized in various different ways. For instance, multiple characteristic impedances may be permitted within the same system (e.g., which can be challenging using current printed circuit technologies). As another example, the additional interconnect can facilitate the creation of local bus structures and have positive impacts in copper density for power distribution. In addition, the multiple-sided flexible circuit structure 571 may more efficiently/effectively integrate specialty voltage regulators (e.g., close to the card load without taking-up more than a threshold area designated for card space). Also depicted and used as described herein (see e.g., description related to FIG. 1) are connector structures 510/520, elastomerics 525, forces 521, printed circuit boards 522.

Figure 6:
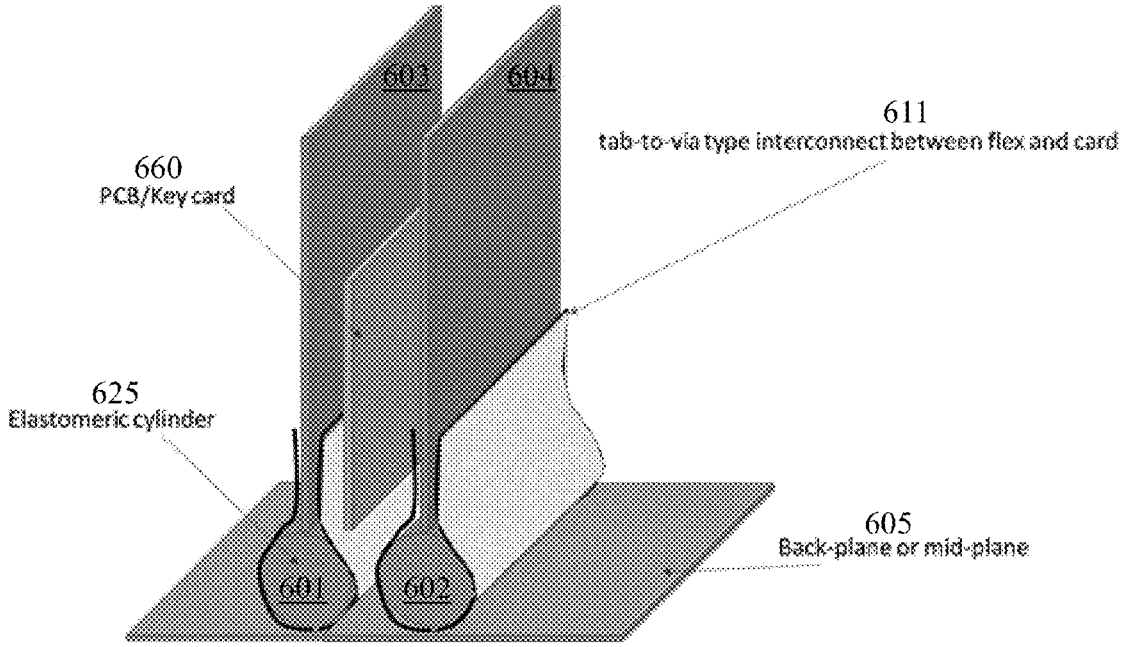
FIG. 6 depicts a perspective view of a set of connector structures and a card which manages a set of electrical connections according to embodiments.

FIG. 6 depicts a perspective view 600 of a set of connector structures and a card which manages a set of electrical connections according to embodiments. Aspects include an enabling security apparatus where a printed circuit board/key card 660 (e.g., a card which manages the set of electrical connections) is inserted/located between two connector structures (e.g., a first connector structure 601 to join a first subset of a set of electrical connections and a second connector structure 602 to join a second subset of the set of electrical connections) to connect with the two connector structures. For instance, the key card can make/break interconnections between the two connector structures (e.g., elastomeric electrical connector structures having an elastomer 625 and a flexible circuit 611 which interconnects with a physical hardware plane). As such, the first and second subsets of the set of electrical connections can include the card. A sequence of making/breaking connections may then be analyzed/interpreted/verified as a valid key to subsequently enable/select additional activity or authorization to occur.

Accordingly, a first physical hardware plane 603 (e.g., printed circuit board, card, side card) may have a first group of electrical contacts to establish a first portion of the first subset of the set of electrical connections with respect to the first elastomeric electrical connector structure. Similarly, a second physical hardware plane 604 (e.g., printed circuit board, card, side card) may have a second group of electrical contacts to establish a second portion of the second subset of the set of electrical connections with respect to the second elastomeric electrical connector structure. In embodiments, the set of electrical connections does not include a backplane 605 (e.g., contents are routed from a first card to the first connector structure to the key card to the second connector structure to the second card).

In embodiments, a plurality of printed circuit boards/key cards (e.g., multiple key cards 660) may be fashioned to provide for multiple tiers for authorization/verification. For example, two cards may be required to: be plugged-in side-by-side/end-to end, be plugged-in in separate locations (simultaneously), or first have one card inserted and removed then followed by one or more cards inserted and removed in sequence in the same location. In certain embodiments, different cards can be enabled to have different levels of authority (e.g., service, authority to load or verify sensitive information). In embodiments, a key card may be active with logic or on-card storage with storage expansion. In embodiments, the key card may be passive with make/break contact sequences.

Figure 7:
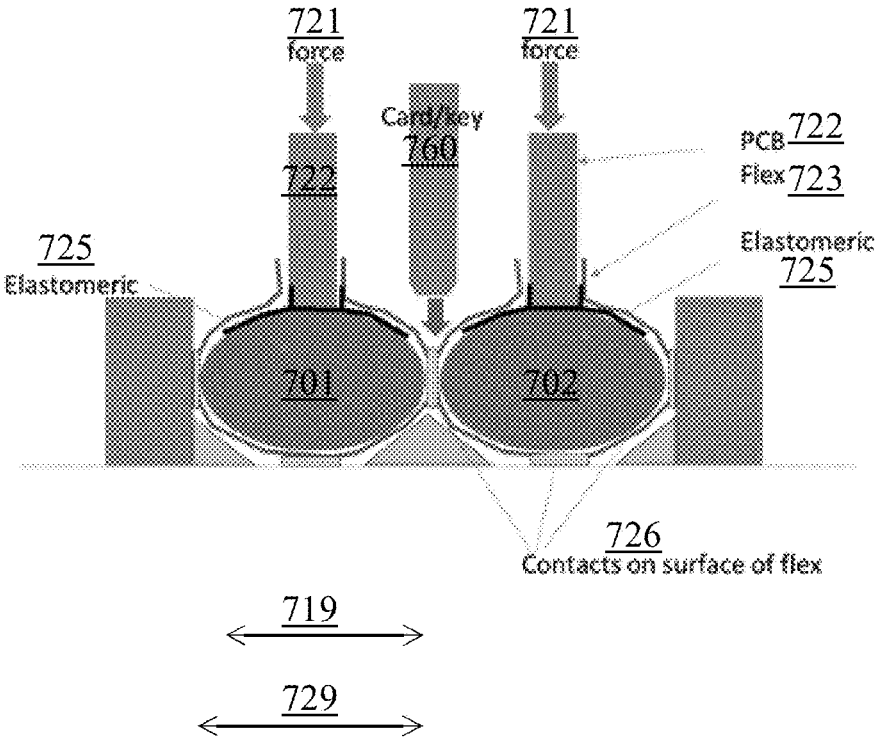
FIG. 7 depicts a side-view of a set of connector structures and a card which manages a set of electrical connections according to embodiments.

FIG. 7 depicts a side-view 700 of a set of connector structures and a card which manages a set of electrical connections according to embodiments. The depicted connector system allows for the insertion of the card 760 between two previously installed printed circuit boards/cards (e.g., cards 722). As such, the card 760 may have access to the signals routed through the connector to the backplane or midplane of the system.

In embodiments, the card 760 interconnects (e.g., allows data/signal transmission including using contacts 726) the first and second connector structures 701, 702. In various embodiments, the card 760 prevents interconnection (e.g., shorts the signal) of the first and second connector structures 701, 702. The first and second connector structures 701, 702 may be first and second elastomeric electrical connector structures having an elastomer 725 and a flexible circuit 723. The first and second elastomeric electrical connector structures can have a compressed state (e.g., resulting from forces 721) and an uncompressed state. The compressed state may include a compressed distance 729 between the card 760 and an opposite side of a compressed elastomeric electrical connector structure with respect to the card 760. The uncompressed state may include an uncompressed distance 719 between the card 760 and the opposite side of an uncompressed elastomeric electrical connector structure with respect to the card. The compressed distance 729 may exceed the uncompressed distance.

In embodiments, the card 760 indicates a sequence of keys inserted into a socket to manage the set of electrical connections (e.g., for use in authentication/verification). In various embodiments, the card 760 monitors a set of encrypted contents (e.g., tracks signal/data transmissions) to manage the set of electrical connections. In certain embodiments, the card 760 decodes a set of encrypted contents (e.g., deciphers a transmission) to manage the set of electrical connections.

In embodiments, the card 760 intercepts a set of contents to manage the set of electrical connections (e.g., intercepting the transmission and then storing its contents elsewhere or processing the contents). In various embodiments, the card 760 reroutes a set of contents to manage the set of electrical connections (e.g., changing the path/destination of the transmission such as no longer sending it through/to the backplane). The card 760 may truncate a set of contents to manage the set of electrical connections (e.g., to use only a portion of a set of data for performance/efficiency reasons). In certain embodiments, the card 760 shorts a set of contents to manage the set of electrical connections (e.g., stops/ends the transmission).

Figure 8:
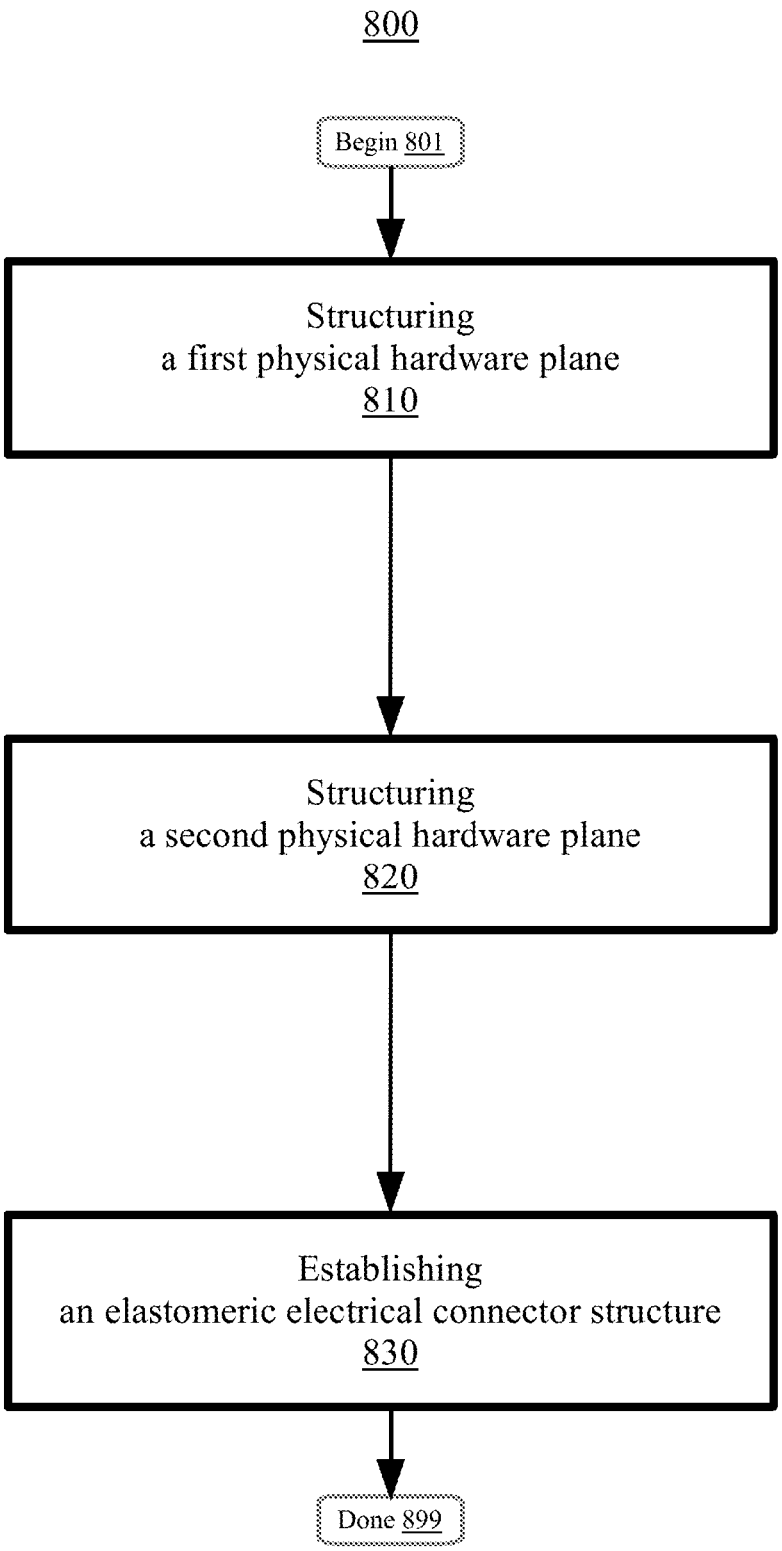
FIG. 8 is a flowchart illustrating a method for manufacturing, according to embodiments.

FIG. 8 is a flowchart illustrating a method 800 for manufacturing, according to embodiments. The method 800 begins at block 801. A first physical hardware plane having a first group of electrical contacts to establish a first portion of a set of electrical connections is structured at block 810. A second physical hardware plane having a second group of electrical contacts to establish a second portion of the set of electrical connections is structured at block 820. An elastomeric electrical connector structure to join the first and second portions of the set of electrical connections is established at block 830. The elastomeric electrical connector structure includes: a first state having a first distance between the first and second physical hardware planes, and a second state having a second distance between the first and second physical hardware planes. The first distance exceeds the second distance. The method 800 concludes at block 899.

Figure 9:
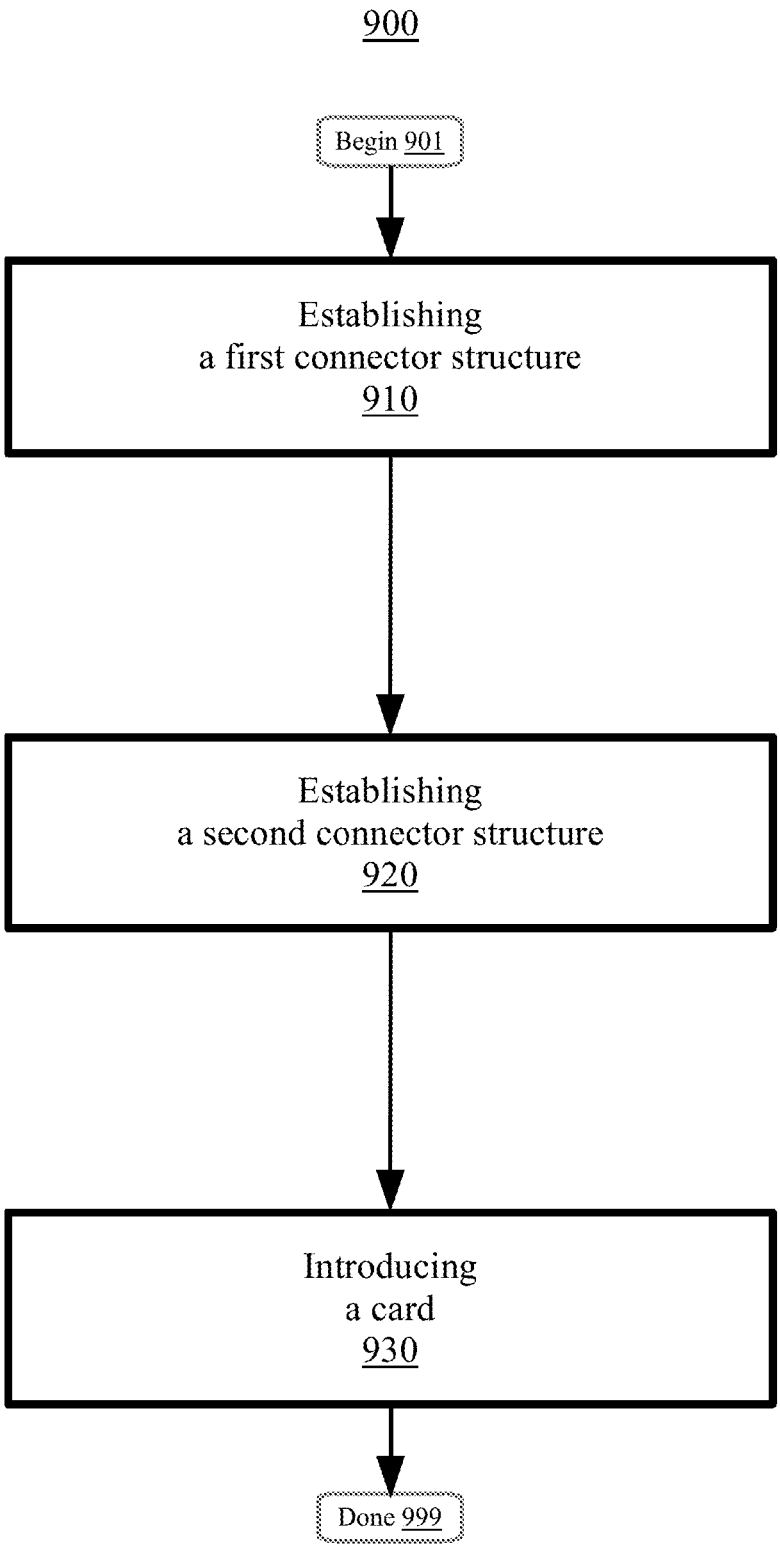
FIG. 9 is a flowchart illustrating a method for manufacturing, according to embodiments.

FIG. 9 is a flowchart illustrating a method 900 for manufacturing, according to embodiments. The method 900 begins at block 901. A first connector structure to join a first subset of a set of electrical connections is established at block 910. A second connector structure to join a second subset of the set of electrical connections is established at block 920. A card which manages the set of electrical connections is introduced at block 930. The card is located between the first and second connector structures to connect with the first and second connector structures. The method 900 concludes at block 999.

Figure 10:
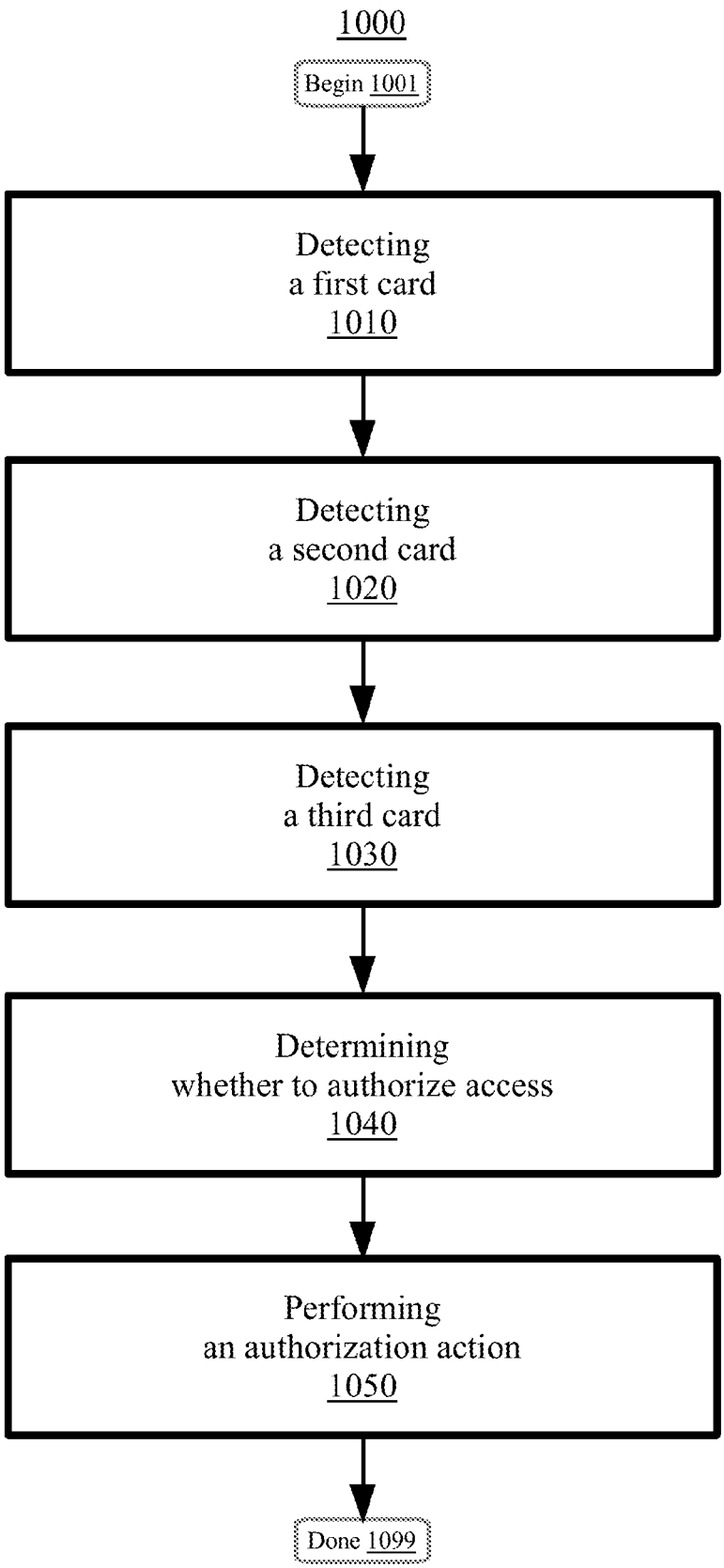
FIG. 10 is a flowchart illustrating a computer-implement method for managing a set of electrical connections according to embodiments.

FIG. 10 is a flowchart illustrating a computer-implement method 1000 for managing a set of electrical connections according to embodiments. The method 1000 begins at block 1001. A first card is detected to be located between the first and second connector structures to connect with the first and second connector structures at block 1010. In response to detecting the first card, a second card is detected to be located between the first and second connector structures to connect with the first and second connector structures at block 1020. In response to detecting the second card, a third card is detected to be located between the first and second connector structures to connect with the first and second connector structures at block 1030. Based on a sequence of cards located between the first and second connector structures to connect with the first and second connector structures, it is determined whether to authorize access with respect to the set of electrical connections at block 1040. Based on the determination, an authorization action is performed at block 1050. The authorization action can at least one of: granting access based on detecting the third card in response to detecting the second card in response to detecting the first card, or denying access based on the sequence of cards failing to match a profile sequence (e.g., second card in response to third card in response to first card). The method 1000 concludes at block 1099.

Figure 11:
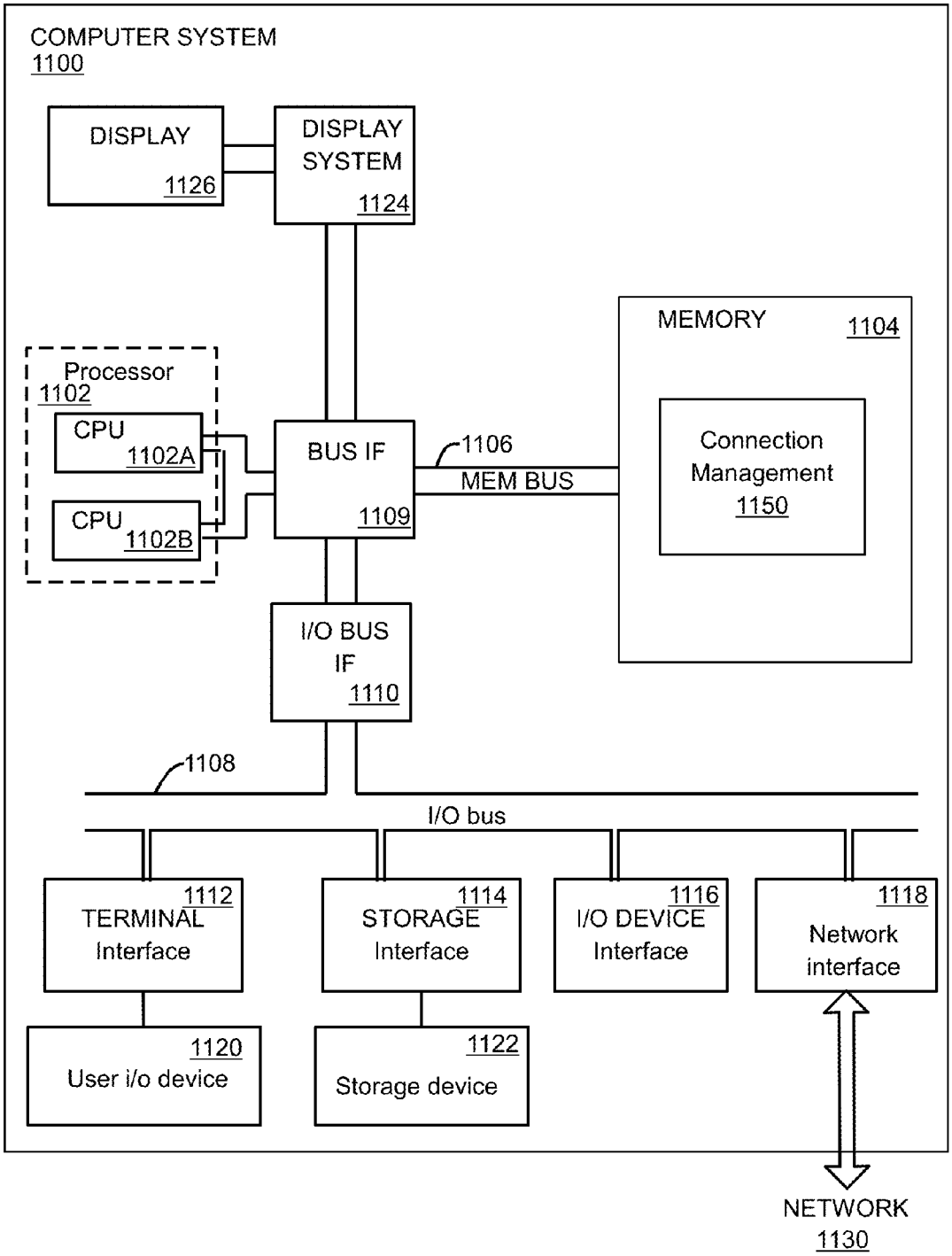
FIG. 11 depicts a high-level block diagram of a computer system for implementing various embodiments of the present disclosure, consistent with various embodiments.

FIG. 11 depicts a high-level block diagram of a computer system for implementing various embodiments of the present disclosure, consistent with various embodiments. The mechanisms and apparatus of the various embodiments disclosed herein apply equally to any appropriate computing system. The major components of the computer system 1100 include one or more processors 1102, a memory 1104, a terminal interface 1112, a storage interface 1114, an I/O (Input/Output) device interface 1116, and a network interface 1118, all of which are communicatively coupled, directly or indirectly, for inter-component communication via a memory bus 1106, an I/O bus 1108, bus interface unit 1109, and an I/O bus interface unit 1110.

The computer system 1100 may contain one or more general-purpose programmable central processing units (CPUs) 1102A and 1102B, herein generically referred to as the processor 1102. In embodiments, the computer system 1100 may contain multiple processors; however, in certain embodiments, the computer system 1100 may alternatively be a single CPU system. Each processor 1102 executes instructions stored in the memory 1104 and may include one or more levels of on-board cache.

In embodiments, the memory 1104 may include a random-access semiconductor memory, storage device, or storage medium (either volatile or non-volatile) for storing or encoding data and programs. In certain embodiments, the memory 1104 represents the entire virtual memory of the computer system 1100, and may also include the virtual memory of other computer systems coupled to the computer system 1100 or connected via a network. The memory 1104 can be conceptually viewed as a single monolithic entity, but in other embodiments the memory 1104 is a more complex arrangement, such as a hierarchy of caches and other memory devices. For example, memory may exist in multiple levels of caches, and these caches may be further divided by function, so that one cache holds instructions while another holds non-instruction data, which is used by the processor or processors. Memory may be further distributed and associated with different CPUs or sets of CPUs, as is known in any of various so-called non-uniform memory access (NUMA) computer architectures.

The memory 1104 may store all or a portion of the various programs, modules and data structures for processing data transfers as discussed herein. For instance, the memory 1104 can store a connection management application 1150. In embodiments, the connection management application 1150 may include instructions or statements that execute on the processor 1102 or instructions or statements that are interpreted by instructions or statements that execute on the processor 1102 to carry out the functions as further described below. In certain embodiments, the connection management application 1150 is implemented in hardware via semiconductor devices, chips, logical gates, circuits, circuit cards, and/or other physical hardware devices in lieu of, or in addition to, a processor-based system. In embodiments, the connection management application 1150 may include data in addition to instructions or statements.

The computer system 1100 may include a bus interface unit 1109 to handle communications among the processor 1102, the memory 1104, a display system 1124, and the I/O bus interface unit 1110. The I/O bus interface unit 1110 may be coupled with the I/O bus 1108 for transferring data to and from the various I/O units. The I/O bus interface unit 1110 communicates with multiple I/O interface units 1112, 1114, 1116, and 1118, which are also known as I/O processors (IOPs) or I/O adapters (IOAs), through the I/O bus 1108. The display system 1124 may include a display controller, a display memory, or both. The display controller may provide video, audio, or both types of data to a display device 1126. The display memory may be a dedicated memory for buffering video data. The display system 1124 may be coupled with a display device 1126, such as a standalone display screen, computer monitor, television, or a tablet or handheld device display. In one embodiment, the display device 1126 may include one or more speakers for rendering audio. Alternatively, one or more speakers for rendering audio may be coupled with an I/O interface unit. In alternate embodiments, one or more of the functions provided by the display system 1124 may be on board an integrated circuit that also includes the processor 1102. In addition, one or more of the functions provided by the bus interface unit 1109 may be on board an integrated circuit that also includes the processor 1102.

The I/O interface units support communication with a variety of storage and I/O devices. For example, the terminal interface unit 1112 supports the attachment of one or more user I/O devices 1120, which may include user output devices (such as a video display device, speaker, and/or television set) and user input devices (such as a keyboard, mouse, keypad, touchpad, trackball, buttons, light pen, or other pointing device). A user may manipulate the user input devices using a user interface, in order to provide input data and commands to the user I/O device 1120 and the computer system 1100, and may receive output data via the user output devices. For example, a user interface may be presented via the user I/O device 1120, such as displayed on a display device, played via a speaker, or printed via a printer.

The storage interface 1114 supports the attachment of one or more disk drives or direct access storage devices 1122 (which are typically rotating magnetic disk drive storage devices, although they could alternatively be other storage devices, including arrays of disk drives configured to appear as a single large storage device to a host computer, or solid-state drives, such as flash memory). In some embodiments, the storage device 1122 may be implemented via any type of secondary storage device. The contents of the memory 1104, or any portion thereof, may be stored to and retrieved from the storage device 1122 as needed. The I/O device interface 1116 provides an interface to any of various other I/O devices or devices of other types, such as printers or fax machines. The network interface 1118 provides one or more communication paths from the computer system 1100 to other digital devices and computer systems; these communication paths may include, e.g., one or more networks 1130.

Although the computer system 1100 shown in FIG. 11 illustrates a particular bus structure providing a direct communication path among the processors 1102, the memory 1104, the bus interface 1109, the display system 1124, and the I/O bus interface unit 1110, in alternative embodiments the computer system 1100 may include different buses or communication paths, which may be arranged in any of various forms, such as point-to-point links in hierarchical, star or web configurations, multiple hierarchical buses, parallel and redundant paths, or any other appropriate type of configuration. Furthermore, while the I/O bus interface unit 1110 and the I/O bus 108 are shown as single respective units, the computer system 1100 may, in fact, contain multiple I/O bus interface units 1110 and/or multiple I/O buses 1108. While multiple I/O interface units are shown, which separate the I/O bus 1108 from various communications paths running to the various I/O devices, in other embodiments, some or all of the I/O devices are connected directly to one or more system I/O buses.

In various embodiments, the computer system 1100 is a multi-user mainframe computer system, a single-user system, or a server computer or similar device that has little or no direct user interface, but receives requests from other computer systems (clients). In other embodiments, the computer system 1100 may be implemented as a desktop computer, portable computer, laptop or notebook computer, tablet computer, pocket computer, telephone, smart phone, or any other suitable type of electronic device.

FIG. 11 depicts several major components of the computer system 1100. Individual components, however, may have greater complexity than represented in FIG. 11, components other than or in addition to those shown in FIG. 11 may be present, and the number, type, and configuration of such components may vary. Several particular examples of additional complexity or additional variations are disclosed herein; these are by way of example only and are not necessarily the only such variations. The various program components illustrated in FIG. 11 may be implemented, in various embodiments, in a number of different manners, including using various computer applications, routines, components, programs, objects, modules, data structures, etc., which may be referred to herein as "software," "computer programs," or simply "programs."

In the foregoing, reference is made to various embodiments. It should be understood, however, that this disclosure is not limited to the specifically described embodiments. Instead, any combination of the described features and elements, whether related to different embodiments or not, is contemplated to implement and practice this disclosure. Many modifications and variations may be apparent to those of ordinary skill in the art without departing from the scope and spirit of the described embodiments.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

Embodiments according to this disclosure may be provided to end-users through a cloud-computing infrastructure. Cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud-computing resources are provided to a user on a pay-per-use basis, where users are charged only for the computing resources actually used (e.g., an amount of storage space used by a user or a number of virtualized systems instantiated by the user). A user can access any of the resources that reside in the cloud at any time, and from anywhere across the Internet. In context of the present disclosure, a user may access applications or related data available in the cloud. For example, the nodes used to create a stream computing application may be virtual machines hosted by a cloud service provider. Doing so allows a user to access this information from any computing system attached to a network connected to the cloud (e.g., the Internet).

Embodiments of the present disclosure may also be delivered as part of a service engagement with a client corporation, nonprofit organization, government entity, internal organizational structure, or the like. These embodiments may include configuring a computer system to perform, and deploying software, hardware, and web services that implement, some or all of the methods described herein. These embodiments may also include analyzing the client's operations, creating recommendations responsive to the analysis, building systems that implement portions of the recommendations, integrating the systems into existing processes and infrastructure, metering use of the systems, allocating expenses to users of the systems, and billing for use of the systems.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

The terminology used herein is for the purpose of describing particular embodiments only and is not intended to be limiting of the various embodiments. As used herein, the singular forms "a," "an," and "the" are intended to include the plural forms as well, unless the context clearly indicates otherwise. "Set of," "group of," "bunch of," etc. are intended to include one or more. It will be further understood that the terms "includes" and/or "including," when used in this specification, specify the presence of the stated features, integers, steps, operations, elements, and/or components, but do not preclude the presence or addition of one or more other features, integers, steps, operations, elements, components, and/or groups thereof. In the previous detailed description of exemplary embodiments of the various embodiments, reference was made to the accompanying drawings (where like numbers represent like elements), which form a part hereof, and in which is shown by way of illustration specific exemplary embodiments in which the various embodiments may be practiced. These embodiments were described in sufficient detail to enable those skilled in the art to practice the embodiments, but other embodiments may be used and logical, mechanical, electrical, and other changes may be made without departing from the scope of the various embodiments. In the previous description, numerous specific details were set forth to provide a thorough understanding the various embodiments. But, the various embodiments may be practiced without these specific details. In other instances, well-known circuits, structures, and techniques have not been shown in detail in order not to obscure embodiments.

Furthermore, although embodiments of this disclosure may achieve advantages over other possible solutions or over the prior art, whether or not a particular advantage is achieved by a given embodiment is not limiting of this disclosure. Thus, the described aspects, features, embodiments, and advantages are merely illustrative and are not considered elements or limitations of the appended claims except where explicitly recited in a claim(s). Therefore, while the foregoing is directed to exemplary embodiments, other and further embodiments of the invention may be devised without departing from the basic scope thereof, and the scope thereof is determined by the claims that follow.

What is claimed is:

1. An apparatus comprising:

a first physical hardware plane having a first group of electrical contacts to establish a first portion of a set of electrical connections, wherein the first physical hardware plane includes a backplane;

a second physical hardware plane having a second group of electrical contacts to establish a second portion of the set of electrical connections, wherein the second physical hardware plane includes a side card, and wherein the second physical hardware plane is substantially perpendicular with respect to the first physical hardware plane; and an elastomeric electrical connector structure to join the first and second portions of the set of electrical connections, wherein the elastomeric electrical connector structure includes:

a first state having a first distance between the first and second physical hardware planes, and a second state having a second distance between the first and second physical hardware planes, wherein the first distance exceeds the second distance.

2. The apparatus of claim 1, wherein the elastomeric electrical connector structure includes an elastomeric core wrapped by a flexible circuit.

3. The apparatus of claim 2, further comprising:

a set of contact pads attached to the flexible circuit.

4. The apparatus of claim 3, wherein a first contact pad of the set of contact pads touches, in the second state, a second contact pad which is not attached to the flexible circuit.

5. The apparatus of claim 4, wherein the second contact pad is attached to a second flexible circuit.

6. The apparatus of claim 5, wherein a second elastomeric electrical connector structure includes a second elastomeric core wrapped by the second flexible circuit.

7. The apparatus of claim 6, further comprising:

a third physical hardware plane having a third group of electrical contacts to establish a third portion of the set of electrical connections, wherein a direct electrical connection of the set of electrical connections includes the second and third portions but not the first portion.

8. The apparatus of claim 2, wherein the flexible circuit is attached on both faces of the second physical hardware plane.

9. The apparatus of claim 1, further comprising:

a set of curbs attached to the first physical hardware plane to align and shape the elastomeric electrical connector structure.

10. The apparatus of claim 1, wherein the first and second distances measure along a substantially perpendicular plane with respect to the first physical hardware plane and a substantially parallel plane with respect to the second physical hardware plane, and wherein the first and second distances measure between a top-face of the first physical hardware plane and a bottom-edge of the second physical hardware plane.

11. The apparatus of claim 10, wherein the first state has a third distance that perpendicularly bisects the first distance between the first and second physical hardware planes, wherein the second state has a fourth distance that perpendicularly bisects the second distance between the first and second physical hardware planes, wherein the third and fourth distances measure across the elastomeric electrical connector structure, and wherein the fourth distance exceeds the third distance.

12. The apparatus of claim 2, wherein the flexible circuit of the elastomeric electrical connector structure has a first physical dimension, and further comprising:

a second elastomeric electrical connector structure having a second elastomeric core wrapped by a second flexible circuit having a second physical dimension, wherein the first and second physical dimensions are different.

13. The apparatus of claim 1, further comprising:

a stiffener structure which is affixed to the first physical hardware plane and coupled with a multiple-sided flexible circuit structure.

14. The apparatus of claim 1, wherein the first physical hardware plane is coupled with a multiple-sided flexible circuit structure.

15. The apparatus of claim 13, further comprising:

a set of contact pads attached to the flexible circuit that touch the multiple-sided flexible circuit structure.

16. The apparatus of claim 1, further comprising:

a second elastomeric electrical connector structure which is a different size relative to the elastomeric electrical connector structure.

* * * * *